US005286912A

United States Patent [19]

Yamaguchi

[11] Patent Number: 5,286,912

[45] Date of Patent: Feb. 15, 1994

[54] ELECTRONIC MUSICAL INSTRUMENT WITH PLAYBACK OF BACKGROUND TONES AND GENERATION OF KEY-ON PHRASE TONES

[75] Inventor: Masafumi Yamaguchi, Hamamatsu, Japan

[73] Assignee: Kabushiki Kaisha Kawai Gakki Seisakusho, Shizuoka, Japan

[21] Appl. No.: 41,881

[22] Filed: Apr. 2, 1993

Related U.S. Application Data

[63] Continuation of Ser. No. 856,698, Mar. 24, 1992, abandoned.

[30] Foreign Application Priority Data

Mar. 29, 1991 [JP] Japan ..... 3-091410

[51] Int. Cl.[5] ..... G10H 7/00; G10H 1/36

[52] U.S. Cl. ..... 84/616; 84/634; 84/654; 84/664

[58] Field of Search ..... 84/610, 616, 634, 654, 84/666

[56] References Cited

U.S. PATENT DOCUMENTS

| | | | |
|---|---|---|---|
| 4,757,737 | 7/1988 | Conti . | |
| 4,771,671 | 9/1988 | Hoff, Jr. | 84/645 X |
| 5,074,182 | 12/1991 | Copps et al. | 84/600 X |
| 5,095,799 | 3/1992 | Wallace et al. | 84/601 X |
| 5,157,215 | 10/1992 | Nakae et al. | 84/624 |

*Primary Examiner*—Bernard Roskoski
*Assistant Examiner*—Jeffrey W. Donels
*Attorney, Agent, or Firm*—Birch, Stewart, Kolasch & Birch

[57] ABSTRACT

An electronic musical instrument with playback of background tones and generation of key-on phrase tones, in which a simple adlib play can be performed while a user is singing using a microphone or as an interlude without requiring high-grade techniques is disclosed.

The electronic instrument includes an instrument main body (1) having a microphone (5) and a plurality of key pads (6), a section for playing back stored background tones of a song, a memory (21) for storing note pattern data for a plurality of phrases each consisting of a series of a plurality of key-on phrases in correspondence with the plurality of key pads, and a tone generator (20) for reading out the note pattern data of the corresponding phrase in response to an operation of the key pad (6), and forming tone generation signals. The output from the microphone, the playback signals of the background tones, and the tone generation signals of the phrase are supplied to a loudspeaker (11). Parallel to the playback background tones, the prestored phases can be read out and played back as needed upon operation of the key pads. A singer sings a selected song while listening to the background tones of the song. Upon combination of some phrases, a simple adlib play is performed, and a joyful performance can be made.

14 Claims, 3 Drawing Sheets

ELECTRONIC MUSICAL INSTRUMENT WITH PLAYBACK OF BACKGROUND TONES AND GENERATION OF KEY-ON PHRASE TONES

This application is a continuation of application Ser. No. 07/856,698 filed on Mar. 24, 1992, now abandoned.

BACKGROUND OF THE INVENTION

1. Field of the Invention

The present invention relates to an electronic musical instrument for electronically generating background tones.

2. Description of the Prior Art

A playback apparatus, called a "sing a song instrument", which plays back background tones or accompaniments of a song recorded on a tape or a compact disk, is known. A singer sings a song while listening to playback of background tones such as orchestral music tones. Such a playback apparatus merely plays back background tones recorded in advance on a recording medium, and a user cannot take part in a performance of such tones.

If not only a singer can sing a song along the playback tones, but also he or she can take part in a performance while singing a song, he or she can enjoy a more joyful performance. However, the conventional "sing a song instrument" does not allow a singer to take part in a background instrument play.

SUMMARY OF THE INVENTION

It is an object of the present invention to provide an electronic musical instrument, which allows a singer to easily take part in a background play while singing a song.

An electronic musical instrument of the present invention comprises an instrument main body having a microphone and a plurality of key pads, means for playing back background tones of a song, memory means for storing note pattern data for a plurality of phrases each consisting of a series of tones and assigned to each of key pads, a tone generator for reading out the note pattern data of the corresponding phrase in response to the operation of the key pad, and forming tone generation signals, and means for mixing the output from the microphone, the playback signals of the background tones, and the tone generation signals of the phrase.

Phrases stored in advance can be read out and played back upon operation of the key pads, as needed. Upon combination of some phrases, an adlib play can be made without requiring high-grade techniques.

DETAILED DESCRIPTION OF THE PREFERRED EMBODIMENT

Figure 1:
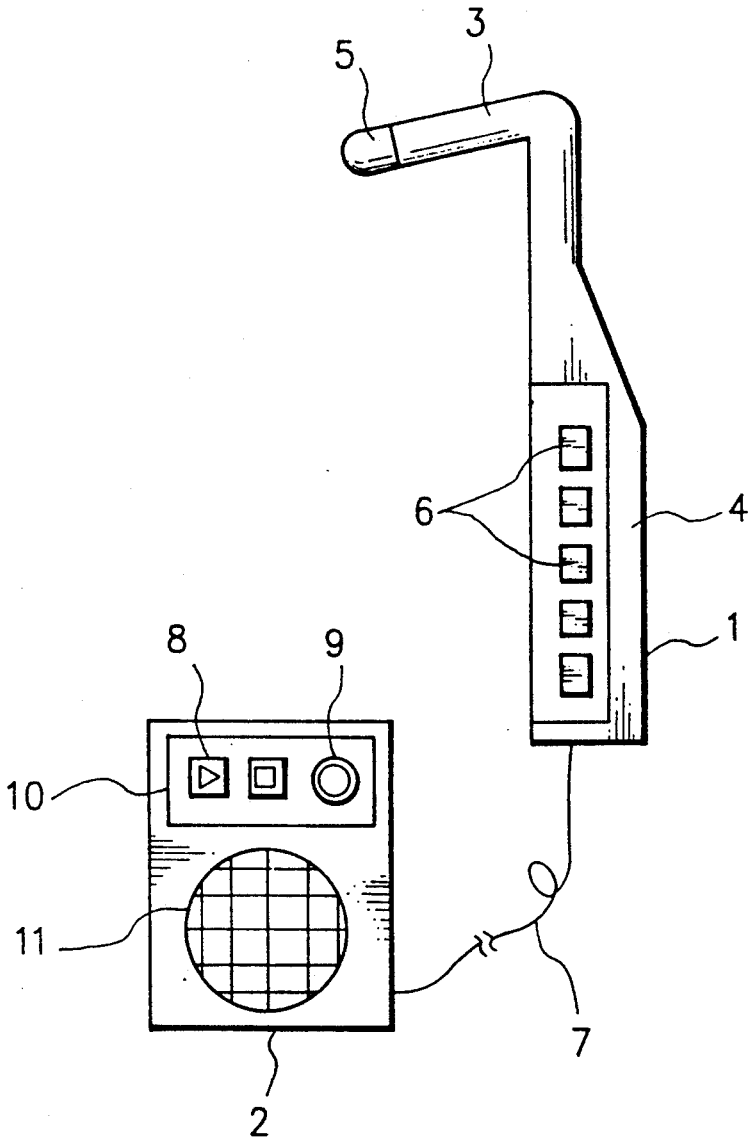
FIG. 1 is a view showing an outer appearance of an electronic musical instrument according to an embodiment of the present invention.

FIG. 1 is a view showing the outer appearance of principal part of an electronic musical instrument according to an embodiment of the present invention. The electronic musical instrument comprises an instrument main body 1 and a tone generator unit 2. The instrument main body 1 is constituted by a neck portion 3 and a body 4. The neck portion 3 is bent at about 90°, and a microphone 5 is attached to the distal end of the neck portion 3. A plurality of key pads 6 are arranged on the body 4.

Signals from the microphone 4 and the key pads 6 are supplied to the tone generator unit 2 through a cord 7. The tone generator unit 2 comprises an operation unit 10 equipped with a play button 8 and a volume knob 9, and a loudspeaker 11.

Figure 2:
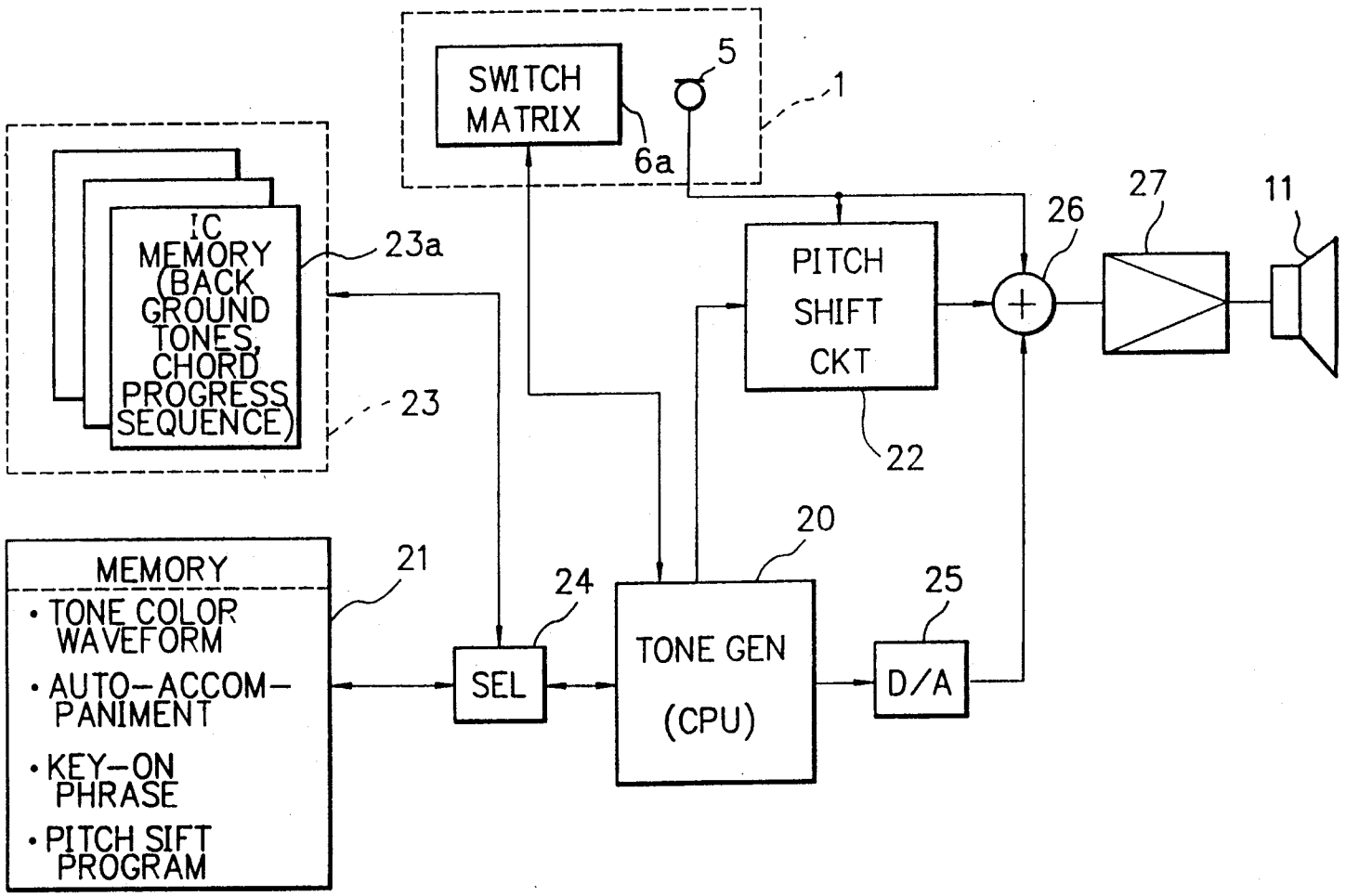
FIG. 2 is a block diagram showing a tone generation circuit of the electronic musical instrument of the embodiment shown in FIG. 1.

FIG. 2 is a block diagram of principal part of the tone generation circuit incorporated in the tone generator unit 2. The tone generation circuit has a tone generator 20 comprising a CPU. The tone generator 20 is connected to a memory 21, and a switch matrix 6*a*, which is coupled to the key pads 6 of the instrument main body 1. The tone generation circuit of this embodiment comprises a pitch shift circuit 22 which shifts the tone pitch of a voice signal input from the microphone 5.

The memory 21 stores tone color waveform data, auto-accompaniment data, key-on phrase play data, pitch shift data, and the like in addition to a program for operating the system. The tone generator unit 2 can receive an external storage medium 23 such as an IC memory card 23*a*. The IC memory card 23*a* stores music piece data for playing back background tones or accompaniment tones of a song, and chord progress data for chord development.

The music piece data is constituted by a note data string for determining a tone color of tones, a key scale, a tone volume, tone generation timings, and a tone generation duration. The tone generator 20 reads music piece data stored in the IC memory card 23*a* tone by tone through a selector 24. At the tone generation timing of a given tone, the tone generator 20 reads out, from the memory 21, tone color waveform data corresponding to the tone at a pitch corresponding to an interval for only the designated tone generation duration, modulates the readout data with the designated tone volume value, and outputs the modulated data to a D/A converter 25. A background tone obtained from the D/A converter 25 is supplied to an adder 26, and is mixed with a voice signal from the microphone 5. The sum signal is supplied to the loudspeaker 11 through an amplifier 27.

The voice signal from the microphone 5 is also supplied to the pitch shift circuit 22. The pitch of the voice signal is automatically shifted by a predetermined interval to form a duet part of a music piece, which is being played at that time, and the pitch-shifted signal is output to the adder 26. The pitch shift data for instructing an interval, a shift timing, and the like is selected from the memory 21 according to selection of a music piece, and the selected data is supplied from the memory 21 to the pitch shift circuit 22 through the tone generator 20 along with the progress of the music piece. Note that the interval (shift width) data may be arbitrarily set by operating buttons of the switch matrix 6*a*. In this manner, the output from the microphone 5 and the output from the pitch shift circuit 22 are supplied to the loudspeaker 11 through the adder 26, so that a singer can enjoy a duet chorus consisting of high- and low-tone parts in a duet part of the music piece.

On the other hand, the tone generator 20 reads out auto-accompaniment data from the memory 21 using another tone generation channel, and forms tone generation signals of accompaniment tones such as chord tones, bass tones, and the like in the same manner as the background tones. Note that the auto-accompaniment data is expressed by a reference chord string such as C major chords, and when a music piece to be read out from the IC memory card 23*a* is determined, the reference chord string is sequentially developed to minor chords, seventh chords, and the like on the basis of the chord progress data stored in the internal memory 21, thus obtaining accompaniment tones suitable for the music piece. Since the auto-accompaniment data stored in the internal memory 21 is processed according to the chord progress data stored in the external memory (IC memory card) 23*a* to desirably obtain various accompaniment music pieces (tones), the storage capacities of the memories 21 and 23*a* can be reduced as compared to a case wherein auto-accompaniment data corresponding in number to the types of accompaniments are stored in the internal or external memory 21 or 23*a*.

The key-on phrase play data stored in the memory 21 is note pattern data, stored in correspondence with the key pads 6 of the instrument main body 1, for playing back different phrase tones for one to several bars per phrase. When one of the key pads 6 is depressed, the tone generator 20 reads out the corresponding key-on phrase play data tone by tone, and converts the readout data into tone generation signals. The key-on phrase play data is constituted by a note data string for determining a tone color of key-on tones, a key scale, a tone volume, tone generation timings, and a tone generation duration. At the tone generation timing of a given tone, the tone generator 20 reads out, from the memory 21, tone color waveform data corresponding to the tone at a pitch corresponding to an interval for only the designated tone generation duration, modulates the readout data with the designated tone volume value, and outputs the modulated data to the D/A converter 25.

The key-on phrase play data is read out in units of phrases. Therefore, when one of the key pads 6 is depressed, phrase tones for several bars are played back. When another key pad is depressed, other phrase tones are played back. In this manner, an adlib-like key-on phrase play can be easily performed by a very simple operation, e.g., by sequentially depressing the key pads 6 for every several bars.

Figure 3:
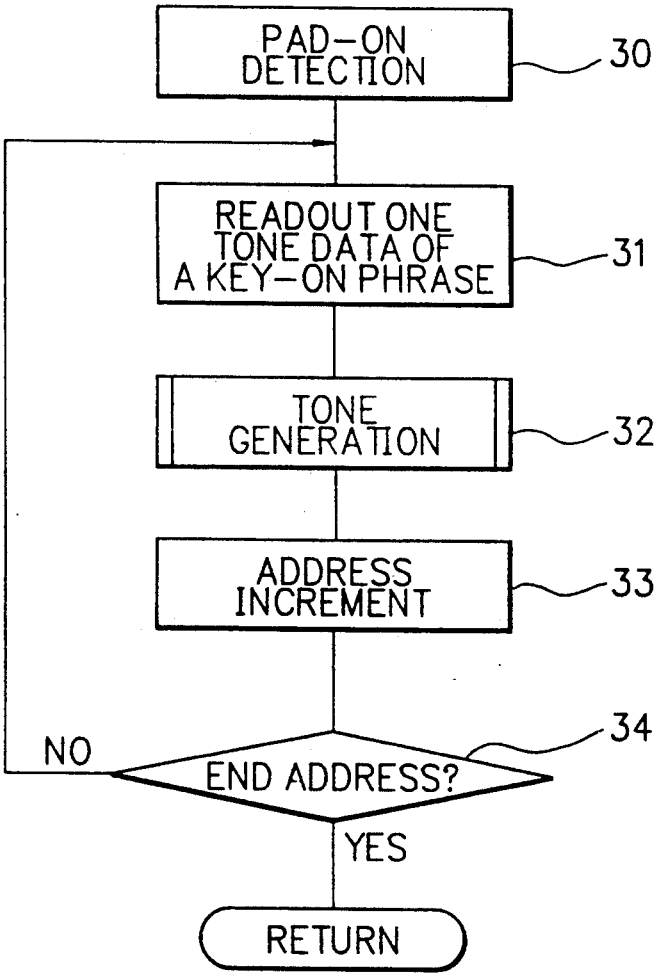
FIG. 3 is a flow chart of CPU processing of generation of adlib phrase tones.

FIG. 3 is a flow chart for explaining the operation of the tone generation circuit shown in FIG. 2.

In step 30, a pad-ON state is detected. In step 31, one tone data of a corresponding key-on phrase is read out. In step 32, tone generation processing to the readout tone data is performed. In step 33, an address is incremented to read out the next tone data. In step 34, it is checked if an end address is reached. If NO in step 34, the flow returns to step 31 to read out the next tone data, and the above-mentioned operation is repeated. When the end address is detected in step 34, tone generation processing for one phrase is ended, and the flow returns to the main routine.

Note that the pitch shift data may be stored in the external storage medium 23*a* in association with music pieces.

The electronic musical instrument of the present invention comprises the instrument main body 1 having the microphone 5 and the plurality of key pads 6, a means (the external storage medium 23 and the tone generator 20) for playing back stored background tones, the memory 21 for storing note pattern data for a plurality of phrases each consisting of a series of tones assigned to each of key pads 6, and the tone generator 20 for reading out the note pattern data of the corresponding phrase in response to the operation of the key pad 6, and forming tone generation signals, wherein the output from the microphone, the playback signals of the background tones, and the tone generation signals of the phrase are output. Therefore, according to the present invention, the phrases stored in advance can be read out and played back upon operation of the key pads, at arbitrary timings. Upon combination of some phrases, a singer can enjoy an adlib play while singing a song using the microphone or as an interlude without requiring skilled techniques.

What is claimed is:

1. An electronic musical instrument comprising:

an instrument main body having a microphone and a plurality of phrase select key pads;

means for playing back background tones of a song;

memory means for storing note pattern data in the form of key-on phrase play data for a plurality of phrases, each phrase consisting of a series of phrase tones comprised of a plurality of bars per phrase for a rhythm, chord, melody or combination thereof; and said phrase select key pads being operated at a time interval of said bars per phrase for automatically generating individual adlib play tones by a player lacking skills for the performance of rhythm, chord and melody using a keyboard, strings or a percussion instrument;

a tone generator for reading out the note pattern data of said phrases in response to selective operation of one or more of said key pads, and forming tone generation signals; and means for mixing the output from said microphone, the playback signals of the background tones, and the tone generation signals of said phrases.

2. An instrument according to claim 1, and wherein said means for playing back background tones incudes a storage medium for storing data of the background tones, and wherein said tone generator reads out the data of the background tones to form the playback signals of the background tones.

3. An instrument according to claim 2, wherein said storage medium comprises an exchangeable IC memory.

4. An instrument according to claim 1, further comprising a pitch shift circuit for shifting a tone pitch of the output from said microphone, and wherein the output from said microphone and the output from said pitch shift circuit are mixed.

5. An instrument according to claim 1, wherein said instrument main body has a stringed instrument-like form constituted by a body and a neck as a whole, said plurality of key pads are arranged on said body, and said microphone is attached to a distal end side of said neck.

6. An instrument according to claim 5, wherein said neck is bent in a V shape in an arrangement plane of said key pads of said body.

7. An instrument according to claim 1, wherein said background tones and phrase tones are developed and pre-programmed on the basis of a melody of a song.

8. An electronic musical instrument comprising:

an instrument body have a microphone and a plurality of phrase select key pads;

an internal memory for storing note pattern data in the form of key-on phrase play data for a plurality of phrases each consisting of a series of tones comprised of a plurality of bars per phrase for a predetermined rhythm, chord, melody or combination thereof;

en external exchangeable memory for storing data of background tones and chord progression data;

tone generator means selectively coupled to both said memories for reading out note pattern data of said phrases in response to arbitrary operation of one or more of said key pads along with predetermined background tones and generating playback signals of the background tones and tone generation signals of said phrases;

means for additionally shifting the pitch of the output from said microphone;

means for mixing the output of said microphone, said pitch shifting means and said tone generator means; and means coupled to said mixing means for generating a composite musical output signal.

9. An instrument according to claim 8 wherein said means for generating said output signal comprises an audio transducer.

10. An instrument according to claim 8 wherein said means for generating said output signal comprises a loudspeaker.

11. An electronic musical instrument comprising:

an instrument body have a microphone and a plurality of phrase select key pads;

an internal memory for storing note pattern data in the form of key-on phrase play data for a plurality of phrases each consisting of a series of tones comprised of a plurality of bars per phrase for a predetermined rhythm, chord, melody or combination thereof;

an external exchangeable memory for storing data of background tones and chord progression data;

a switch matrix coupled to said key pads;

tone generator means selectively coupled to both said memories and to said switch matrix for reading out note pattern data of said phrases in response to player actuation of one or more of said key pads along with predetermined background tones and generating playback signals of the background tones and tone generation signals of said phrases;

means for additionally shifting the pitch of the output from said microphone;

means for mixing the output of said microphone, said pitch shifting means and said tone generator means generating a sum signal; and output means coupled to said mixing means and being responsive to said sum signal for generating a composite musical output signal.

12. A instrument according to claim 11 wherein said output means includes a loudspeaker.

13. An instrument according to claim 12 wherein said output means additionally includes amplifier means coupled between said mixing means and said loudspeaker.

14. An electronic musical instrument comprising:

an instrument main body having a microphone and a plurality of phrase select key pads;

means for playing back background tones of a song;

memory means for storing note pattern data in the form of key-on phrase play data for a plurality of phrases, each consisting of a series of tones comprised of a plurality of bars per phrase for a rhythm, chord, melody or combination thereof;

a tone generator for reading out the note pattern data of said phrases in response to selective operation of one or more of said key pad and forming tone generation signals;

a pitch shift circuit for shifting a tone pitch of the output from said microphone; and means for mixing the output from said microphone, the output from said pitch shift circuit, the playback signals of the background tones, and the tone generation signals.

* * * * *